US005629208A

United States Patent [19]

Darredeau et al.

[11] Patent Number: 5,629,208

[45] Date of Patent: May 13, 1997

[54] METHOD FOR CONTROLLING IMPURITIES IN AN INSTALLATION FOR THE SEPARATION OF AIR

[75] Inventors: Bernard Darredeau, Sartrouville; Amélie Jacomet, Paris, both of France

[73] Assignee: L'Air Liquide, Societe Anonyme pour L'Etude et L'Exploitation des Procedes Georges Claude, Paris Cedex, France

[21] Appl. No.: 463,741

[22] Filed: Jun. 5, 1995

[30] Foreign Application Priority Data

Feb. 7, 1995 [FR] France ..... 95 01388

[51] Int. Cl.[6] ..... F25J 3/00

[52] U.S. Cl. ..... 436/55; 436/50; 436/106; 436/116; 422/67; 62/651; 62/654; 62/656; 62/913

[58] Field of Search ..... 436/55, 43, 50, 436/106, 116, 118; 422/67, 68.1, 82.05; 62/23, 24, 25, 38, 41, 125, 126, 129, 628, 640, 651, 652, 654, 646, 656, 913

[56] References Cited

U.S. PATENT DOCUMENTS

| | | | |
|---|---|---|---|
| 4,045,191 | 8/1977 | Martin | 55/179 |
| 5,313,802 | 5/1994 | Agrawal et al. | 62/22 |
| 5,412,953 | 5/1995 | Darredeau et al. | 62/25 |
| 5,463,870 | 11/1995 | Rieth | 62/25 |
| 5,477,689 | 12/1995 | Guillard et al. | 62/25 |
| 5,507,148 | 4/1996 | Mostello | 62/24 |
| 5,515,688 | 5/1996 | Rieth | 62/646 |
| 5,526,647 | 6/1996 | Grenier | 62/654 |

*Primary Examiner*—Long V. Le
*Attorney, Agent, or Firm*—Young & Thompson

[57] ABSTRACT

A method for the control of the operation of an installation for the separation of air by cryogenic distillation comprising a double distillation column wherein the top of a medium pressure column and the base of a low pressure column are thermally interconnected by a vaporizer-condenser supplied with liquid oxygen from a bath of liquid oxygen in the base of the low pressure column. Liquid oxygen from the bath is continuously tested to detect the content of nitrous oxide in the bath, and upon the detection of a fall in the nitrous oxide content of the bath when the installation is operating under equilibrium conditions, the flow of liquid oxygen to the vaporizer-condenser is increased to raise the detected nitrous oxide content of the bath. But when the detected nitrous oxide level falls, then either a liquid oxygen purge line is opened farther, or else the operating time or pressure of switching adsorbers in the air supply is changed.

6 Claims, 1 Drawing Sheet

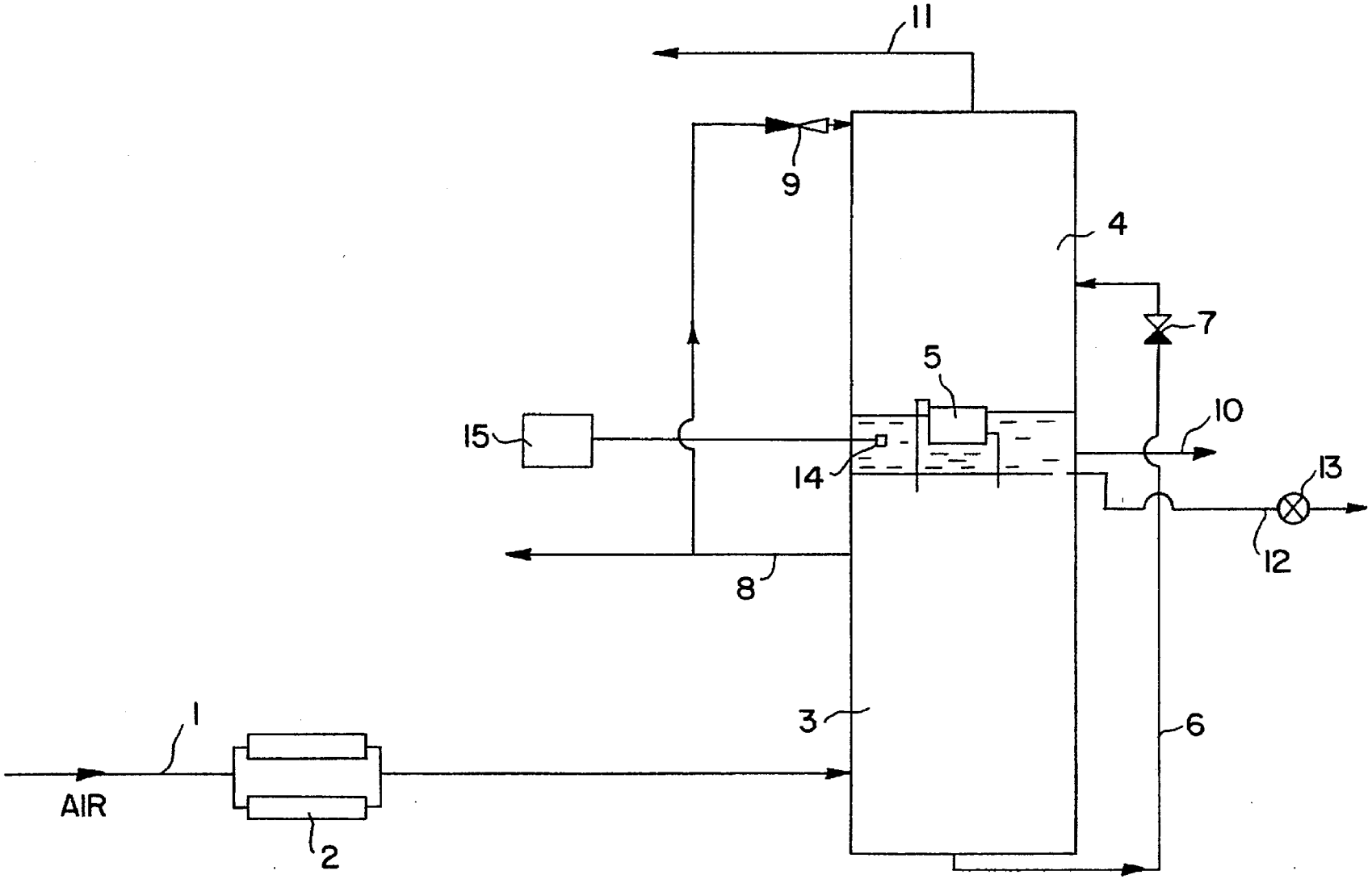
AIR
1
2
3
4
5
6
7
8
9
10
11
12
13
14
15

METHOD FOR CONTROLLING IMPURITIES IN AN INSTALLATION FOR THE SEPARATION OF AIR

FIELD OF THE INVENTION

The present invention has for its object a method for surveillance of the operation of an installation for the separation of air or of gas from air by cryogenic distillation and more particularly for controlling the concentration of impurities in a liquid oxygen bath in such an apparatus.

BACKGROUND OF THE INVENTION

Air treated in these air separation installations contains a certain number of impurities. Most of them, such as hydrocarbons and nitrogen oxides, are less volatile than oxygen and accumulate in the liquid in the vaporizer. In the case of a simple column, there will be a vaporizer-head condenser in which accumulates rich liquid and in the case of a double column, there is generally a vaporizer-condenser which ensures heat exchange between the oxygen of the low pressure column and either the nitrogen of the medium pressure column, or the pressurized air, or any other cycle fluid (preferably the nitrogen at a pressure different than that of the medium pressure column).

Being less soluble (the solubility being only about several ppm), these impurities give rise, alone or in combination, to various dangers, particularly to the risk of explosion. They are therefore to be eliminated. Different means are used to prevent any accumulation, in particular removal by adsorption, in liquid or gaseous phase such as described in DE-A-19.36.049, or purging the liquid from the vaporizer.

Safety requires on the one hand preventing the accumulation of dangerous impurities, on the other hand the surveillance to make sure that these are effective and efficacious.

Until now, attention has been focussed on the hydrocarbons, particularly acetylene. Surveillance of the good operation of the elimination means is achieved by following the hydrocarbon content, in general by chromatography (for example, with detection by flame ionization), although analysis by chromatography is costly and difficult to conduct.

Nowadays, removal of carbon dioxide and water from air supplied to an installation is achieved by adsorption upstream of the cryogenic separation. A certain number of air impurities, in particular unsaturated hydrocarbons are, at least partially, removed by this purification by adsorption. Others, including some of the nitrogen oxides, continue to the cold box which contains the column or columns. The means to prevent the accumulation of these impurities in the liquid in the vaporizer can therefore be simplified, because of the presence of the adsorption system, but not removed and it is necessary to continue to monitor whether the devices for this purpose are efficacious.

No matter what the operation of the apparatus provided with an adsorption system upstream of the cryogenic separation (producing for example liquid or gaseous oxygen), the hydrocarbon content in the liquid in the vaporizer is, ordinarily, negligible and often undetectable, except for the alkanes (methane, ethane, propane), but a knowledge of their content is not of interest because the prevention devices are substantially ineffective relative to these pollutants which, moreover, are not dangerous. The non-detection of hydrocarbons does not mean for all that, that the prevention means used are efficacious because, most often, the limiting factors for their dimensioning are the nitrogen oxides. On the other hand, they are relatively difficult to measure, and the use of a chromatograph is required. Surveillance of the hydrocarbons therefore does not permit verifying, in a simple and certain manner, efficacious operation of the safety means used.

OBJECTS OF THE INVENTION

The invention has for its object to provide a method for surveillance of the operation of an air separation installation which is easy to use and efficacious to detect the malfunction of the devices used to avoid the accumulation of impurities in the liquid in the vaporizer.

SUMMARY OF THE INVENTION

To this end, the invention provides a method of surveillance of the operation of an installation for the separation of air or of a gas from air by cryogenic distillation comprising a distillation column and a vaporizer-condenser, characterized in that variations in the nitrous oxide content which accumulate in the liquid of the vaporizer-condenser are detected.

According to other novel characteristics of the invention:

- the nitrous oxide content of the liquid is continuously measured;
- the nitrous oxide content is measured with an infrared radiation analyzer;
- the nitrous oxide content of the liquid which accumulates in the vaporizer-condenser is measured;
- the variations in the nitrous oxide content of the liquid are continuously detected.

An apparatus for practicing this method comprises means to detect variations in the nitrous oxide content of the bath of a vaporizer-condenser of the installation.

According to other characteristics:

- the vaporizer-condenser is located at the base of a low-pressure column of a double column;
- the means to detect the variations is an infrared radiation analyzer.

The invention thus uses an analyzer to measure the nitrous oxide content of the bath of a vaporizer-condenser of an air distillation column.

Given its characteristics, nitrous oxide will be seen to be very appropriate as an indicator of efficacious operation of the safety means. On the one hand, its content in air is relatively constant, of the order of 0.3 to 0.4 ppm. When the installation is at equilibrium, the nitrous oxide content of the bath of the vaporizer-condenser is therefore constant and solely a function of the respective production of liquid and gaseous oxygen by the latter. On the other hand, nitrous oxide is a less volatile constituent which therefore has a tendency to accumulate in the liquid oxygen in the vaporizer. It is therefore unfavorable in terms of safety. Finally, nitrous oxide is relatively soluble in liquid oxygen, having a solubility of the order of 180 ppm at 90° K. The maximum content of nitrous oxide which is acceptable in the bath of the vaporizer is thus easily detectable, being about 20 to 30 ppm, in the liquid oxygen in the base of a low-pressure column.

These properties render the nitrous oxide content of the liquid oxygen bath or of the rich liquid of the vaporizer very sensitive to the operation of the installation. In particular, poor functioning of a safety purge, for example because of an obstruction in the purge conduit, or of the vaporizer (dry vaporization) translates into variations of content of the bath of the order of several ppm (parts per million), even tens of ppm, which are therefore very easily detectable. Following the nitrous oxide content of the bath of the vaporizer therefore permits an efficacious surveillance of the operation of the prevention means.

Moreover, analysis of nitrous oxide can be effected by an infrared radiation analyzer more economical and more simple to use than a chromatograph. This analyzer moreover permits continuous analysis of the nitrous oxide content, which the chromatograph cannot do. The use of a chromatograph is however not to be excluded.

Analysis by chromatography of the hydrocarbons in the liquid of the vaporizer can therefore be replaced by a continuous surveillance of the nitrous oxide ($N_2O$) content of this same liquid. It renders more efficacious and more economical the surveillance of the good operation of the prevention means which have been used to avoid any accumulation of impurities in the neighborhood of the vaporizer.

The device permitting the detection of at least the variations of nitrous oxide content can be mounted on the purge of the vaporizer-condenser, which permits purifying the liquid bath continuously. Otherwise, the device could be mounted at the level of the bath of the vaporizer.

This invention is applicable as well to methods of surveillance of installations comprising a vaporizer-condenser of the type designated "with bath" as to methods of surveillance of installations comprising a vaporizer "with film" such as described, for example, in patent EP-B-130.122.

BRIEF DESCRIPTION OF THE DRAWING

The above and other features and advantages of the present invention will become more apparent from a consideration of the following specification, taken in connection with the accompanying drawing, in which:

The single FIGURE is a diagrammatic view of an air separation installation adapted for the practice of the present invention.

DETAILED DESCRIPTION OF THE INVENTION

Referring now to the drawing in greater detail, there is shown an air separation installation in connection with which the present invention can be practiced, comprising an inlet 1 for the supply of air which will be compressed, purified in alternately on-stream adsorbers 2 of which the off-stream adsorber is desorbed by use of a separation product, further compressed, cooled, and if desired expanded before introduction into the air separation apparatus. For clarity of illustration, only the air inlet 1 and the switching adsorbers 2 are shown, as everything upstream of the air separation column, and indeed most of the air separation column itself, is entirely conventional.

Thus, as is usual, the feed air at its dew point is introduced into a lower portion of a medium pressure column 3 of an air distillation double column comprising, in addition to medium pressure column 3, a low pressure column 4. Columns 3 and 4 are, as is conventional, thermally interconnected by a vaporizer-condenser 5, for example of the type shown in U.S. Pat. No. 5,333,683, the disclosure of which is incorporated herein by reference.

In such a vaporizer-condenser, gaseous nitrogen from the top of medium pressure column 3 flows through certain vertical passageways (not shown) thereof, whilst liquid oxygen with certain impurities that has collected in the bottom of low pressure column 4 is introduced into the remaining vertical passageways thereof, the liquid oxygen, as is conventional, being partially vaporized in the course of condensing at least a portion of the gaseous nitrogen.

As is also conventional, liquid rich in oxygen is withdrawn from the base of medium pressure column 3 via conduit 6 and expanded through a Joule-Thomson expansion valve 7 and introduced at its appropriate composition level at a point intermediate the height of low pressure column 4.

As is further conventional, a portion of the liquid nitrogen condensing at the head of medium pressure column 3 is withdrawn through a conduit 8, part of the withdrawn liquid nitrogen being withdrawn as a product of the operation, the rest of the liquid nitrogen at medium pressure being expanded through a Joule-Thomson valve 9 to the pressure of the low pressure column 4 and introduced into the top of the low pressure column 4 as reflux.

A liquid oxygen product is withdrawn at 10 from the base of low pressure column 4 and gaseous nitrogen is withdrawn via 11 from the top of low pressure column 4.

A purge line 12 also extends from the base of low pressure column 4, by which a portion of the liquid oxygen is purged to remove impurities from the bath that collects at the base of low pressure column 4. Purge line 12 is under the control of a valve 13, that can be opened or closed to a varying extent, thereby to control the volume of flow through purge line 12.

According to the invention, a sample collector 14 is immersed in the bath of liquid oxygen at the base of low pressure column 4, and is surrounded by that bath on all sides. Sample collector 14 removes a small sample of liquid oxygen from the bath and transmits it to an infrared radiation analyzer 15 outside the distillation column. Analyzer 15 can be of the type disclosed in any of U.S. Pat. Nos. 5,340,452; 5,292,666; 4,682,031; 4,326,807; 4,306,153; 4,176,963 or 3,925,667, the disclosures of all of which are incorporated herein by reference.

Such analyzers are adapted to effect a continuous analysis of the nitrous oxide content of the sample withdrawn by collector 14 and to display or otherwise provide a continuous means for surveillance of this nitrous oxide content.

In operation, as is conventional, air from inlet 1 passes through the on-stream one of the purifying adsorbers 2, the off-stream adsorber 2 being purged as mentioned above, each adsorber 2 being adapted to operate at a controllable pressure and for a selected time between switching from one adsorber to the other.

Similarly, the vaporizer-condenser 5 is selectively controlled as to the flow rate of liquid oxygen that is introduced thereinto.

Finally, the purge line 12 is controllable as to the quantity of liquid oxygen withdrawn as purge, thanks to the adjustable valve 13.

Once the air separation apparatus is at steady state or equilibrium operation, then samples are continuously collected by sample collector 14 and transmitted to infrared radiation analyzer 15 for continuous analysis of the nitrous oxide content in the bath of the base of low pressure column 4. Under equilibrium conditions, if the apparatus is functioning properly, then the readings of nitrous oxide content continuously given by analyzer 15 will tend to remain substantially constant.

But if those readings should rise or fall, all other things being equal, then this rise or fall, according to the present invention, is a simple, quick and sensitive indication of malfunction which needs to be corrected.

If the nitrous oxide level in the bath falls, as determined by analyzer 15, this means that the level of liquid oxygen in the vaporizer is not high enough and that so-called "dry vaporization" is taking place. When dry vaporization takes place, the nitrous oxide crystallizes out within the liquid oxygen passageways of the vaporizer-condenser, which ultimately plugs these passageways. The concentration of nitrous oxide thus crystallized out, means that the bath outside the vaporizer-condenser will be impoverished of nitrous oxide: hence the fall in nitrous oxide level detected by the analyzer 15.

On the other hand, if the nitrous oxide level as detected by analyzer 15 rises, under equilibrium conditions, that is, all other things being equal, then this means that the flow through the purge 12 is too low and this flow is increased until the nitrous oxide level in the bath returns to normal as determined by the analyzer 15. The purge flow rate can be too low either because there is blockage in the purge line or else because the valve 13 is insufficiently open; and so to correct this, the operator will open valve 13 farther, and if this does not succeed, will remove blockage from the purge line 12.

A rise in nitrous oxide level detected by analyzer 15 can also mean that the adsorbers 2 are not operating properly. To correct this, the operator will reset one or both of the pressure and the cycle time of the adsorbers 2.

In short: if the detected nitrous oxide level falls, the operator will increase the flow of liquid oxygen to the adsorber/condenser; but if it rises, then the operator will first open the purge line farther, either by manipulation of valve 13 or by clearing blockage from the purge line; and if this does not restore the nitrous oxide level, then the operator will change at least one of the pressure and cycle time of the adsorbers 2.

Although the present invention has been described and illustrated in connection with a preferred embodiment, it is to be understood that modifications and variations may be resorted to without departing from the spirit of the invention, as those skilled in the art will readily understand. Such modifications and variations are considered to be within the purview and scope of the present invention as defined by the appended claims.

We claim:

1. In a method for controlling operation of an installation for separation of air by cryogenic distillation comprising a double distillation column wherein a top of a medium pressure column and a base of a low pressure column are thermally interconnected by a vaporizer-condenser supplied with liquid oxygen from a bath of liquid oxygen in the base of the low pressure column; the improvement comprising continuously measuring nitrous oxide in said bath, and upon detection of a fall in nitrous oxide content of the bath when the installation is operating under equilibrium conditions, increasing a flow of liquid oxygen to said vaporizer-condenser to raise the measured nitrous oxide content of the bath.

2. A method as claimed in claim 1, wherein said detection is performed with an infrared radiation analyzer.

3. In a method for controlling operation of an installation for separation of air by cryogenic distillation comprising a double distillation column wherein a top of a medium pressure column and a base of a low pressure column are thermally interconnected by a vaporizer-condenser supplied with liquid oxygen from a bath of liquid oxygen in the base of the low pressure column and impurities are purged from the bath by removal of liquid oxygen from the bath through a purge line; the improvement comprising continuously measuring nitrous oxide in said bath, and upon detection of a rise in nitrous oxide content of the bath when the installation is operating under equilibrium conditions, increasing a flow of liquid oxygen through said purge line to lower the measured nitrous oxide content of the bath.

4. A method as claimed in claim 3, wherein said detection is performed with an infrared radiation analyzer.

5. In a method for controlling operation of an installation for separation of air by cryogenic distillation comprising a plurality of switching adsorbers through at least one of which air passes at an adjustable pressure and for an adjustable time whilst at least one other said adsorber undergoes purging, thus-purified air then passing to a double distillation column wherein a top of a medium pressure column and a base of the low pressure column are thermally interconnected by a vaporizer-condenser supplied with liquid oxygen from a bath of liquid oxygen in the base of the low pressure column; the improvement comprising continuously measuring nitrous oxide in said bath, and upon detection of a rise in nitrous oxide content of the bath when the installation is operating under equilibrium conditions, changing at least one of said adjustable pressure and adjustable time so as to lower the measured nitrous oxide content of the bath.

6. A method as claimed in claim 5, wherein said detection is performed with an infrared radiation analyzer.

* * * * *